United States Patent [19]

Wahlquist et al.

[11] Patent Number: 5,017,219

[45] Date of Patent: May 21, 1991

[54] UTILIZATION OF SPONGE METAL FINES

[75] Inventors: Randy W. Wahlquist, Ogden; John M. Reinarts, North Ogden; Timothy L. Francis, Ogden, all of Utah

[73] Assignee: Westinghouse Electric Company, Pittsburgh, Pa.

[21] Appl. No.: 526,739

[22] Filed: May 21, 1990

[51] Int. Cl.[5] ..... C22B 34/00

[52] U.S. Cl. ..... 75/415; 75/617; 420/590; 428/545; 428/567

[58] Field of Search ..... 75/617, 616, 415, 615, 75/594; 420/590; 428/545, 567

[56] References Cited

U.S. PATENT DOCUMENTS

| | | | |
|---|---|---|---|
| 2,753,256 | 7/1956 | Olson | 75/617 |
| 2,760,857 | 8/1956 | Eton | 75/617 |
| 2,773,760 | 12/1956 | Winter | 75/617 |
| 2,809,108 | 10/1957 | Singleton | 75/617 |
| 2,816,828 | 12/1957 | Benedict | 75/617 |
| 3,396,777 | 8/1968 | Reding | 75/67 R |
| 3,634,066 | 1/1972 | Matthews | 75/65 R |

*Primary Examiner*—Peter D. Rosenberg

[57] ABSTRACT

Normally reject sponge metal fines, especially those produced by the crushing and screening of a regulus of zirconium and/or hafnium metal sponge, are added to the initial reduction charge of the metal tetrachloride and magnesium metal, and the so-modified charge is then passed through the conventional reduction and vacuum distillation steps to produce a regulus of the metal that has the reject fines incorporated therein by sintering.

5 Claims, No Drawings

UTILIZATION OF SPONGE METAL FINES

BACKGROUND OF THE INVENTION

1. Field

The invention is concerned with methods of utilizing, to economic advantage, sponge metal fines such as are inevitably produced during crushing of a sponge metal regulus to produce particle sizes that can be pressed into sponge metal compacts.

2. Description of the Prior Art

The highly pyrophoric fines that inevitably result from the crushing of sponge metal, such as a regulus of zirconium and/or hafnium sponge metal produced in the reduction of the zirconium and/or hafnium tetrachloride powder resulting from chlorination of zircon sand in the process of producing relatively pure zirconium and/or hafnium metal, are normally burned to produce zirconium and/or hafnium oxide and are then added to the chlorination step of the overall process. However, this way of getting rid of these hazardous fines does not represent a recovery of their potential economic value.

In the co-pending application of Abodishish, Wahlquist, and Lopez, Ser. No. 07/437,948, filed Nov. 17, 1989, held under common ownership with the present application and in which one of the joint inventors, Randy W. Wahlquist, is a joint inventor here, such sponge metal fines are processed in a special vacuum distillation operation resembling the usual treatment of zirconium and/or hafnium sponge in a vacuum distillation furnace to remove magnesium and magnesium chloride, but involving lowering the usual charge-melting temperature in the furnace to below the melting point of the magnesium and magnesium chloride components of the furnace charge so that these components solidify about the sponge fines, whereupon furnace temperature is increased to an extent sufficient to vaporize the magnesium and magnesium chloride and to sinter the sponge fines into a sponge regulus which can be further processed in the usual manner.

SUMMARY OF THE INVENTION

In accordance with this invention, which preceded that of the aforementioned invention of Abodishish, Wahlquist, and Lopez application, it has been recognized that in order for the sponge fines to sinter they must be wetted with magnesium and that this will occur automatically if such fines are added to the normal reduction charge of the metal tetrachloride and magnesium during the initial stage of the reduction process and that sintering will occur during normal vacuum distillation.

Thus, the invention provides, first, if necessary, for cleaning the fines to remove any NaCl salt that is commonly added as a fire-control expedient; then, for adding the clean fines along with the magnesium to the metal tetrachloride powder prior to reduction; and, then, for proceeding with the usual reduction process and the usual vacuum distillation cycle.

It has been found that during reaction of the charge in the reduction stage, the added reject fines are wet with molten magnesium and form a distinct layer of sponge at the bottom of the furnace crucible. During the conventional subsequent vacuum distillation, they are sintered to form a coherent mass or regulus of sponge metal, either attached to or separate from the normal regulus formed by the normal components of the reduction charge.

DETAILED DESCRIPTION OF THE PREFERRED EMBODIMENT

The best mode presently contemplated for carrying out the process of the invention in actual practice is to add the clean reject sponge metal fines (ordinarily those fines that are below minus 20 mesh, Standard Tyler Screen) to the conventional reduction furnace crucible charge of the material to be reduced, e.g. zirconium and/or hafnium tetrachloride powder and the usual magnesium metal.

It has been found that reduction of such a charge by the usual procedure applied in a conventional reduction furnace produces a distinct layer of impure sponge at the bottom of the crucible below the usual metal sponge. The thus reduced charge is passed through the conventional vacuum distillation cycle of the overall processing to produce a substantially pure sponge metal product in which the added reject sponge metal fines are incorporated, by sintering, in a sponge metal regulus portion below and either attached to or separate from a portion essentially identical with a regulus produced in the normal way, i.e., without the addition of reject fines. Whether attached together or separate, it has been found that the two regulus portions can be used together as by crushing and compacting.

The normal vacuum distillation stage involves the steps of first removing moisture from the sponge metal charge received from the reduction stage, e.g. from zirconium and/or hafnium metal sponge, by subjecting such sponge metal charge to a temperature of from about 300° to about 350° C. under high vacuum of approximately 50 microns of mercury for approximately twenty-five hours. Thereafter, the temperature is raised to about 450° C. for a period of approximately twenty-two hours to remove the water of hydration of magnesium chloride that is usually present in large amount. Next, the temperature is raised to about 750° C. for starting the vaporization of magnesium metal. After approximately ten hours, the temperature is raised to approximately 900° C. for vaporizing the magnesium chloride. Following elimination of the magnesium chloride, the temperature is raised to approximately 960° C. to start the sintering of the charge and then to approximately 1040° C. for a period of about 10 hours to complete the sintering.

As in the process of the previously mentioned copending application, considerable savings are made and safety is enhanced by being able to handle reject sponge metal fines in this way, but, in contrast to the process of such copending application, no special procedures are necessary in the vacuum distillation stage of the reduction process. This is carried out in the normal manner, e.g. as described above. The only difference in the conventional processing is that the reject fines are added along with the magnesium metal to the charge of metal tetrachloride in the initial reduction stage of the sponge metal production process.

Whereas this invention is here described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim as our invention:

1. A method of utilizing sponge metal fines of a metal selected from the group consisting of zirconium, hafnium and mixtures thereof, comprising forming an initial reduction charge of a tetrachloride of the metal concerned, of magnesium metal, and of said sponge metal fines; applying heat to said charge to reduce the tetrachloride to sponge metal in which said fines form a sponge metal layer at the bottom of the charge; and subjecting the so reduced charge to vacuum distillation to produce a sponge metal regulus having a lower portion in which said reject sponge metal fines are incorporated.

2. A method according to claim 1, wherein the sponge metal fines are first cleaned to remove any associated fire-retardant salt.

3. A method according to claim 1, wherein reduction is carried out in a conventional reduction furnace and distillation is carried out in a conventional vacuum distillation furnace.

4. A method according to claim 1, wherein the sponge metal fines are obtained from the crushing and screening of a regulus.

5. A method according to claim 1, wherein the sponge metal fines are of size at or below minus 20 mesh Standard Tyler Screen.

* * * * *